US007489111B2

(12) United States Patent
Wise

(10) Patent No.: US 7,489,111 B2
(45) Date of Patent: Feb. 10, 2009

(54) HOLSTERED CORDLESS POWER TOOL

(75) Inventor: Robert Wise, Petaluma, CA (US)

(73) Assignee: Robert W. Wise, Petaluma, CA (US)

( * ) Notice: Subject to any disclaimer, the term of this patent is extended or adjusted under 35 U.S.C. 154(b) by 0 days.

(21) Appl. No.: 11/299,235

(22) Filed: Dec. 8, 2005

(65) Prior Publication Data

US 2007/0132428 A1 Jun. 14, 2007

(51) Int. Cl.

| | |
|---|---|
| ***H02J 7/00*** | (2006.01) |
| ***A45F 3/14*** | (2006.01) |
| ***A45F 5/00*** | (2006.01) |
| ***A45F 3/00*** | (2006.01) |
| ***A45C 1/04*** | (2006.01) |

(52) U.S. Cl. ..... 320/137; 224/902; 224/904; 224/674; 224/223

(58) Field of Classification Search ..... 320/112, 320/137; 224/630, 192, 195, 246, 261, 625, 224/902, 905, 904

See application file for complete search history.

(56) References Cited

U.S. PATENT DOCUMENTS

| | | | | |
|---|---|---|---|---|
| 3,919,615 | A * | 11/1975 | Niecke | 320/112 |
| 4,677,362 | A | 6/1987 | House, II et al. | |
| 4,779,687 | A | 10/1988 | Schreiber et al. | |
| 4,827,534 | A | 5/1989 | Haugen | |
| 4,966,321 | A | 10/1990 | Outlaw | |
| 5,095,259 | A | 3/1992 | Bailey et al. | |
| 5,211,321 | A * | 5/1993 | Rodriguez | 224/604 |
| 5,562,240 | A | 10/1996 | Campbell | |
| 5,810,232 | A | 9/1998 | Meurer et al. | |
| 5,929,597 | A * | 7/1999 | Pfeifer et al. | 320/107 |
| 6,016,944 | A | 1/2000 | Girbert | |
| 6,065,658 | A * | 5/2000 | Hashimoto | 224/647 |
| 6,087,815 | A * | 7/2000 | Pfeifer et al. | 323/282 |
| 6,106,971 | A | 8/2000 | Spotnitz | |
| 6,155,471 | A | 12/2000 | Lichtenberger | |
| 6,188,228 | B1 | 2/2001 | Philipp | |
| 6,211,662 | B1 | 4/2001 | Bijawat et al. | |
| 6,301,997 | B1 | 10/2001 | Welte | |
| 6,490,186 | B2 | 12/2002 | Cho | |
| 6,501,197 | B1 | 12/2002 | Cornog et al. | |

(Continued)

FOREIGN PATENT DOCUMENTS

| | | |
|---|---|---|
| CA | 2 313 141 A1 | 12/2001 |

(Continued)

*Primary Examiner*—Edward Tso
*Assistant Examiner*—Alexis Boateng
(74) *Attorney, Agent, or Firm*—Michael A. Glenn; Glenn Patent Group

(57) ABSTRACT

The invention comprises a cordless power tool that has a power umbilical in the form of a coiled cord that connects the power tool to a power source, which in the preferred embodiment is a battery pack. In contrast to prior art approaches, the invention integrates the power tool with the power source in a holstered arrangement. Provision is also made for operating the power tool from an AC source while the batteries are being charged, in the event the battery charge is depleted during use. In this way, the tool is operable at all times because the tool is logically and readily integrated with the power source. Further, the removal from the power source from the tool itself by means of the coiled cord umbilical means that the power tool is lighter and easier to handle.

4 Claims, 6 Drawing Sheets

U.S. PATENT DOCUMENTS

| | | | | |
|---|---|---|---|---|
| 6,502,949 | B1 | 1/2003 | Horiyama et al. | |
| 6,641,107 | B1 | 11/2003 | Janssen | |
| 6,688,407 | B2 | 2/2004 | Etter et al. | |
| 6,720,949 | B1 | 4/2004 | Pryor et al. | |
| 6,729,743 | B2 | 5/2004 | Gillette | |
| 6,851,487 | B1 | 2/2005 | Shotey | |
| 6,926,473 | B2 | 8/2005 | Luebke | |
| 6,939,641 | B2 | 9/2005 | Kincaid et al. | |
| 7,015,675 | B1 * | 3/2006 | Andre | 320/114 |
| 2001/0035736 | A1 * | 11/2001 | Person | 320/114 |
| 2001/0053313 | A1 | 12/2001 | Luebke | |
| 2002/0085403 | A1 | 7/2002 | Cho | |
| 2003/0058638 | A1 | 3/2003 | Gillette | |
| 2003/0066666 | A1 | 4/2003 | Etter et al. | |
| 2003/0090162 | A1 | 5/2003 | Cornog et al. | |
| 2003/0102346 | A1 | 6/2003 | Chen | |
| 2003/0121682 | A1 | 7/2003 | Carrancho | |
| 2003/0160075 | A1 | 8/2003 | Musarella et al. | |
| 2003/0213829 | A1 | 11/2003 | Bruins et al. | |
| 2004/0050887 | A1 * | 3/2004 | Spielberger | 224/244 |
| 2004/0089689 | A1 | 5/2004 | Lammerding | |
| 2004/0121224 | A1 | 6/2004 | Kincaid et al. | |
| 2004/0140336 | A1 | 7/2004 | Estabaya | |
| 2004/0206522 | A1 | 10/2004 | Etter et al. | |
| 2004/0226174 | A1 | 11/2004 | Etter et al. | |
| 2005/0058893 | A1 | 3/2005 | O'Neal | |
| 2005/0078303 | A1 | 4/2005 | Murray | |
| 2005/0082920 | A1 | 4/2005 | Heigl et al. | |
| 2005/0111214 | A1 | 5/2005 | Zeiler | |
| 2005/0115724 | A1 | 6/2005 | Shotey | |
| 2005/0133552 | A1 | 6/2005 | Lawrence | |
| 2005/0152131 | A1 | 7/2005 | Shirane | |
| 2005/0153596 | A1 | 7/2005 | Van Wambeke et al. | |
| 2005/0161305 | A1 | 7/2005 | Jenni et al. | |
| 2005/0200087 | A1 | 9/2005 | Vasudeva et al. | |
| 2005/0218182 | A1 | 10/2005 | Berry et al. | |
| 2005/0223902 | A1 | 10/2005 | Lovell | |

FOREIGN PATENT DOCUMENTS

| | | | |
|---|---|---|---|
| CA | 2420424 | | 8/2004 |
| EP | 0 416 162 | A1 | 3/1991 |
| EP | 1 344 609 | A1 | 9/2003 |
| EP | 1 508 407 | A1 | 2/2005 |
| EP | 1 582 302 | A2 | 10/2005 |
| GB | 2 383 765 | A | 7/2003 |
| GB | 2409831 | | 7/2005 |
| WO | WO 95/12220 | | 10/1994 |
| WO | WO 98/57436 | | 12/1998 |
| WO | WO 99/27391 | | 6/1999 |
| WO | WO 00/77876 | A1 | 12/2000 |
| WO | WO 01/91978 | A2 | 12/2001 |
| WO | WO 03/071895 | A1 | 9/2003 |
| WO | WO2005/058554 | | 6/2005 |
| WO | WO 2005/077031 | A2 | 8/2005 |

* cited by examiner

HOLSTERED CORDLESS POWER TOOL

BACKGROUND OF THE INVENTION

1. Technical Field

The invention relates to power tools. More particularly, the invention relates to a holstered cordless power tool.

2. Description of the Prior Art

Cordless power tools are well known and highly reliable. In the case of a cordless power tool, such as a cordless electric drill, a detachable battery pack is typically inserted into the tool's handle to power the tool. When the charge on the battery pack is depleted, the battery pack is readily removed from the tool and another battery pack, containing a full charge, can be substituted therefore, while the depleted pack is recharged in a charger unit.

It has been suggested that the battery pack may be replaced with an adapter that allows the power tool to be operated either from a remote battery pack or from another power source. It has further been suggested that the power tool may be connected to a cable which is then connected to a power source, such as a battery pack, which may be worn on the user's person.

In the case of a standard cordless power tool, the weight of the battery affects the applicability of the tool for certain users, such as those people who have less strength in their hands, for example smaller persons or older persons. The use of a cord, either through an adapter or, through an arrangement where the cord is a permanent feature of the power tool, can be effective in lightening the weight of the tool and thus make the tool more useful. However, the use of a cord itself in lieu of the battery pack, reproduces the problem that the cordless tool was designed to avoid, that is it makes the device less portable. Further, in such approach, one must either drag the external power source along by the cord, for example by setting it on a table or other surface while the tool is being used; or the person wears it in the form of a vest. In all such cases, the power tool, while portable with regard to the need for an AC power source, is nonetheless more cumbersome.

It would be advantageous to provide a power tool that can be operated from a portable power source, such as a battery, and yet that provides an integrated and easy to carry and use configuration.

SUMMARY OF THE INVENTION

The invention comprises a cordless power tool that has a power umbilical in the form of a coiled cord that connects the power tool to a power source, which in the preferred embodiment is a battery pack. In contrast to prior art approaches, the invention integrates the power tool with the power source in a holstered arrangement. Provision is also made for operating the power tool from an AC source while the batteries are being charged, in the event the battery charge is depleted during use. In this way, the tool is operable at all times because the tool is logically and readily integrated with the power source. Further, the removal from the power source from the tool itself by means of the coiled cord umbilical means that the power tool is lighter and easier to handle.

DETAILED DESCRIPTION OF THE INVENTION

The invention comprises a cordless power tool that has a power umbilical in the form of a coiled cord that connects the power tool to a power source, which in the preferred embodiment is a battery pack. In contrast to prior art approaches, the invention integrates the power tool with the power source in a holstered arrangement. Provision is also made for operating the power tool from an AC source while the batteries are being charged, in the event the battery charge is depleted during use. In this way, the tool is operable at all times, because the tool is logically and readily integrated with the power source. Further, the removal from the power source from the tool itself by means of the coiled cord umbilical means that the power tool is lighter and easier to handle.

Figure 1:
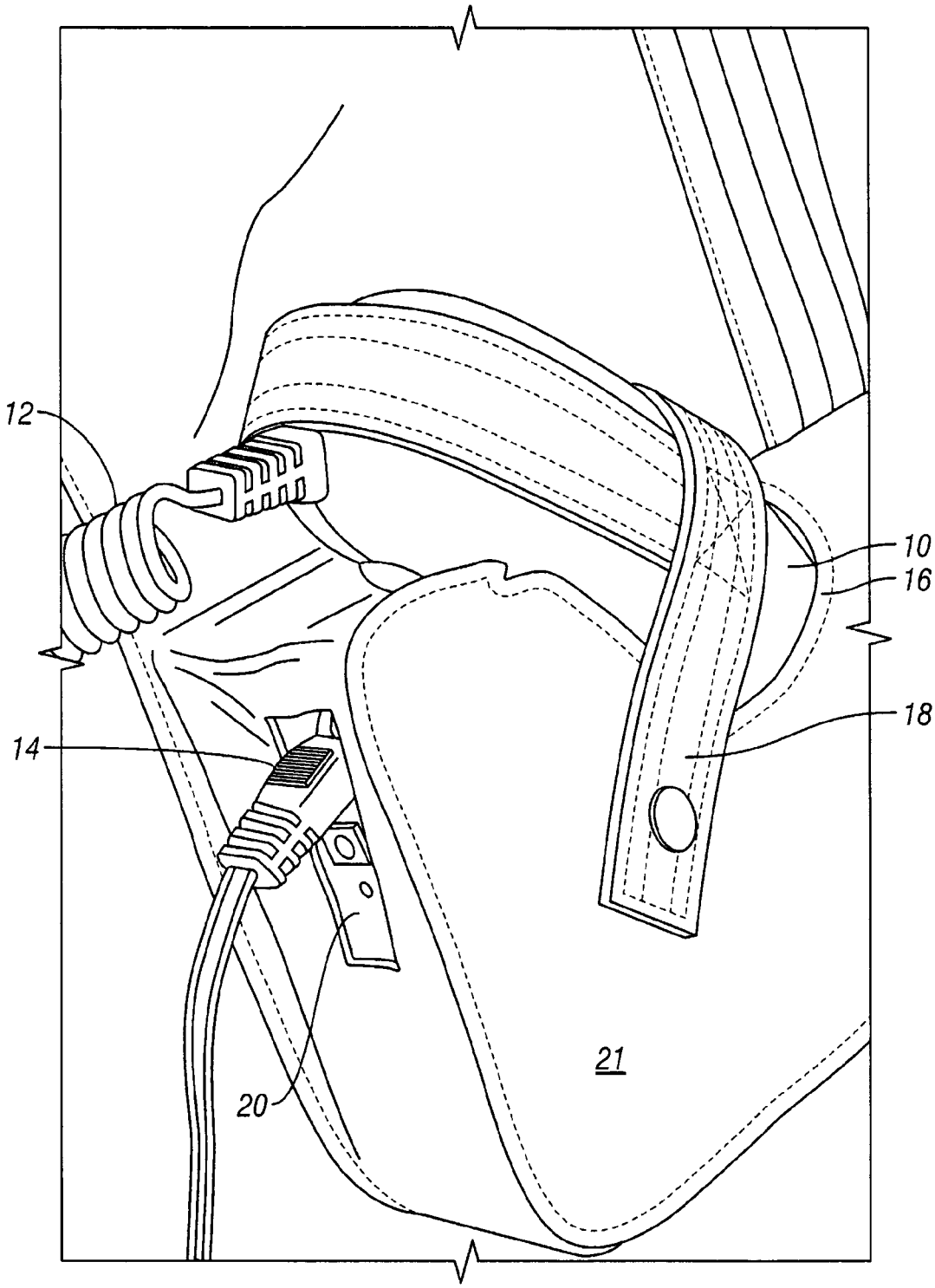
FIG. 1 is a perspective view of a power tool holstered to a carrier, which incorporates a battery pack according the invention.

In FIG. 1 a power tool 10, which in the preferred embodiment is a drill but which those skilled in the art will understand can be any electrically powered tool, is shown nestled in a holster receptacle 16 which is integrated into a battery pack 21. A strap 18 is provided for securing the power tool in the holstered position when the power tool is not in use. The strap includes a fastener, such as a snap or Velcro®. An umbilical in the form of a coiled cable 12 connects the power tool to the power source 21 via a connector 14 which has a mating receptacle on a power panel 20.

Figure 2:
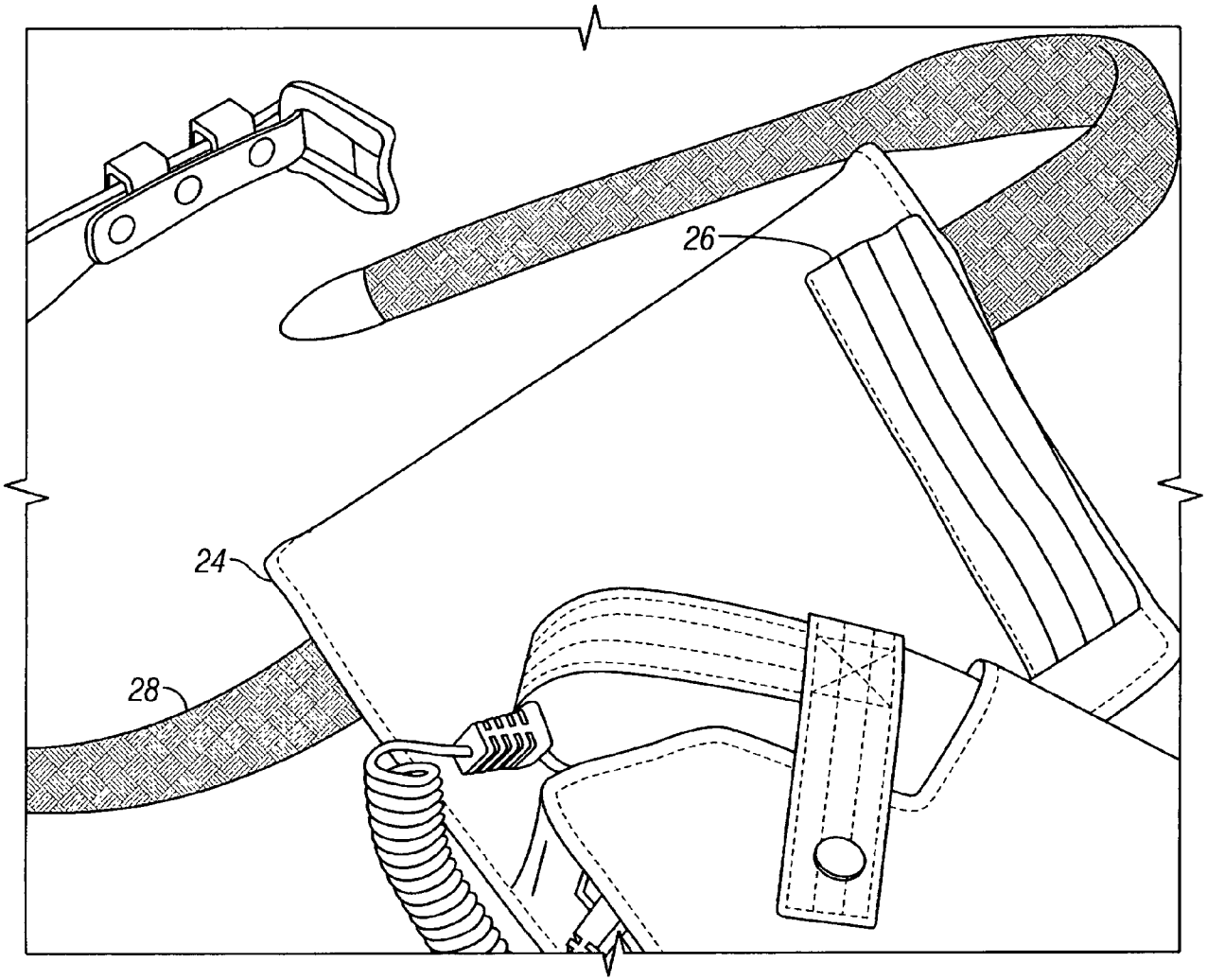
FIG. 2 is a perspective view of the holstered power tool showing one embodiment, which includes a series of tool holders and a belt arrangement.

FIG. 2 shows the power tool, holstered and, in this embodiment, a belt loop 24 is provided to which a belt 28 may be threaded, such that the power tool may be worn on the person as a holstered tool. The power tool holster also includes a series of compartments 26 which may be used to hold various accessories for the tools, such as drill bits or blades.

Figure 3:
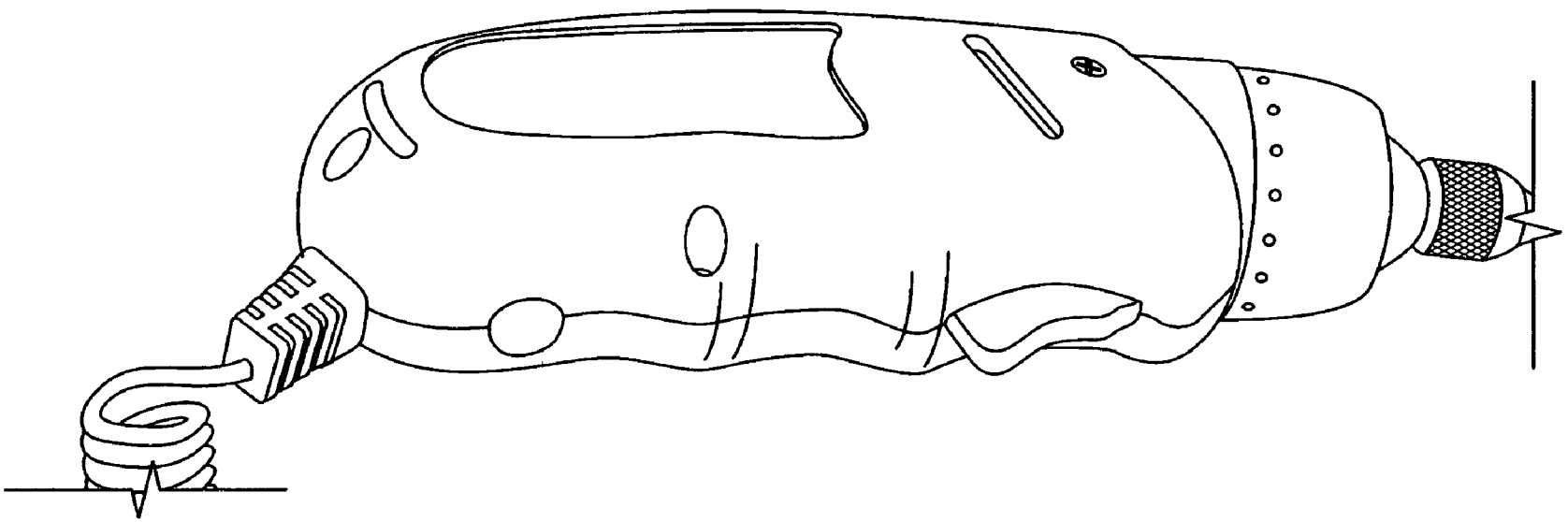
FIG. 3 is a perspective view of a power tool according to the invention.

FIG. 3 is a perspective view of a power tool, which in the preferred embodiment is an electric drill. Although the invention may be used with other power tools. The power tool is ergonomically designed to fit the user's hand. Because the power tool does not include a power source in the handle, the power tool may have a small profile and yet still provide a powerful motor for performing useful work. Power drills themselves are known in the art, but the drill in this case is specifically designed to operate in connection with an integrated power source, such as a rechargeable battery pack. Because the power source in the preferred embodiment is worn on the user's belt, the power source may be a much more heavy duty source than would normally be provided in the handle of a drill. In the case of the prior art drill in which the power source is included in the drill's handle, the weight of the drill becomes a factor. As such drills are currently made, many individuals are not able to use these drills because of the weight added to the handle. One feature of the invention not only removes this weight from the handle, thereby producing a lighter weight power tool, but also allows the incorporation of a much heavier duty battery pack into the power pack 21. Thus, in the case of the present invention, a power supply may be provided that operates at 6 volts, 12 volts, 18 volts, 24 volts, or 36 volts, for example. Further, because the power pack is a larger power pack, the weight being borne, for example on the user's waist through a belt, the power supply can provide power to the tool for a longer period of time without having a need to be recharged and/or can operate a power tool motor having a higher energy requirement, therefore producing greater torque.

Figure 4:
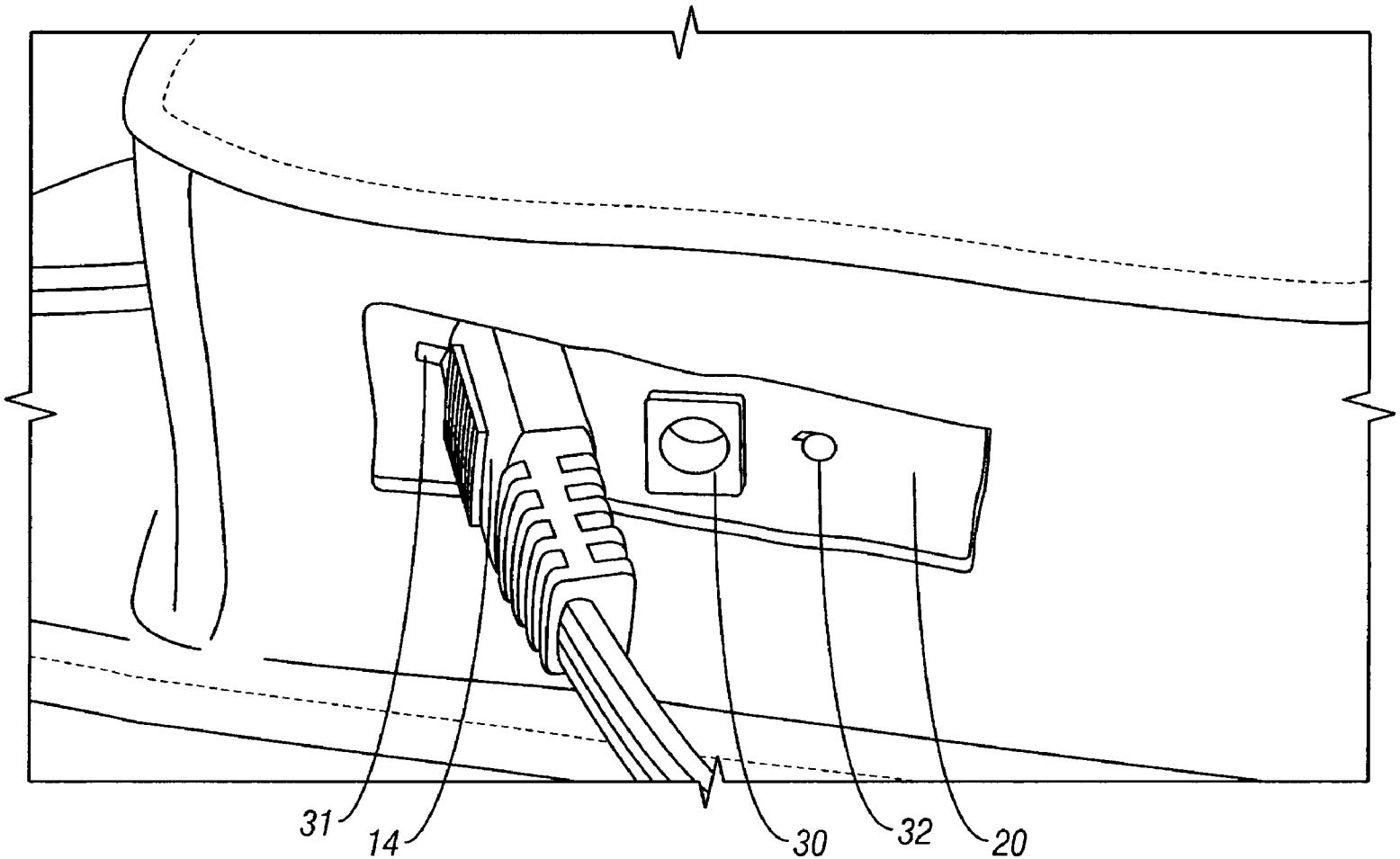
FIG. 4 is a perspective view of a power panel showing a power tool connector according to the invention.

FIG. 4 shows the power panel 20 which, in the preferred embodiment, is accessible via a cut out in the power pack 21. The power plug 14 for the power tool is shown mated with a receptacle 31. The power pack can thus operate any device having a mating connector and similar voltage requirements, such as a light. In this regard, more than one receptacle can be provided to operate more than one tool or accessory at a time. Also shown in FIG. 4 is a receptacle 30 for an external power source that may be used to recharge the battery when the battery's charge is depleted, and which is also used to provide power for operation of the power tool while the battery is being charged. Operation of the external power source is shown by an indicator 32 which in the preferred embodiment is an LED.

Figure 5:
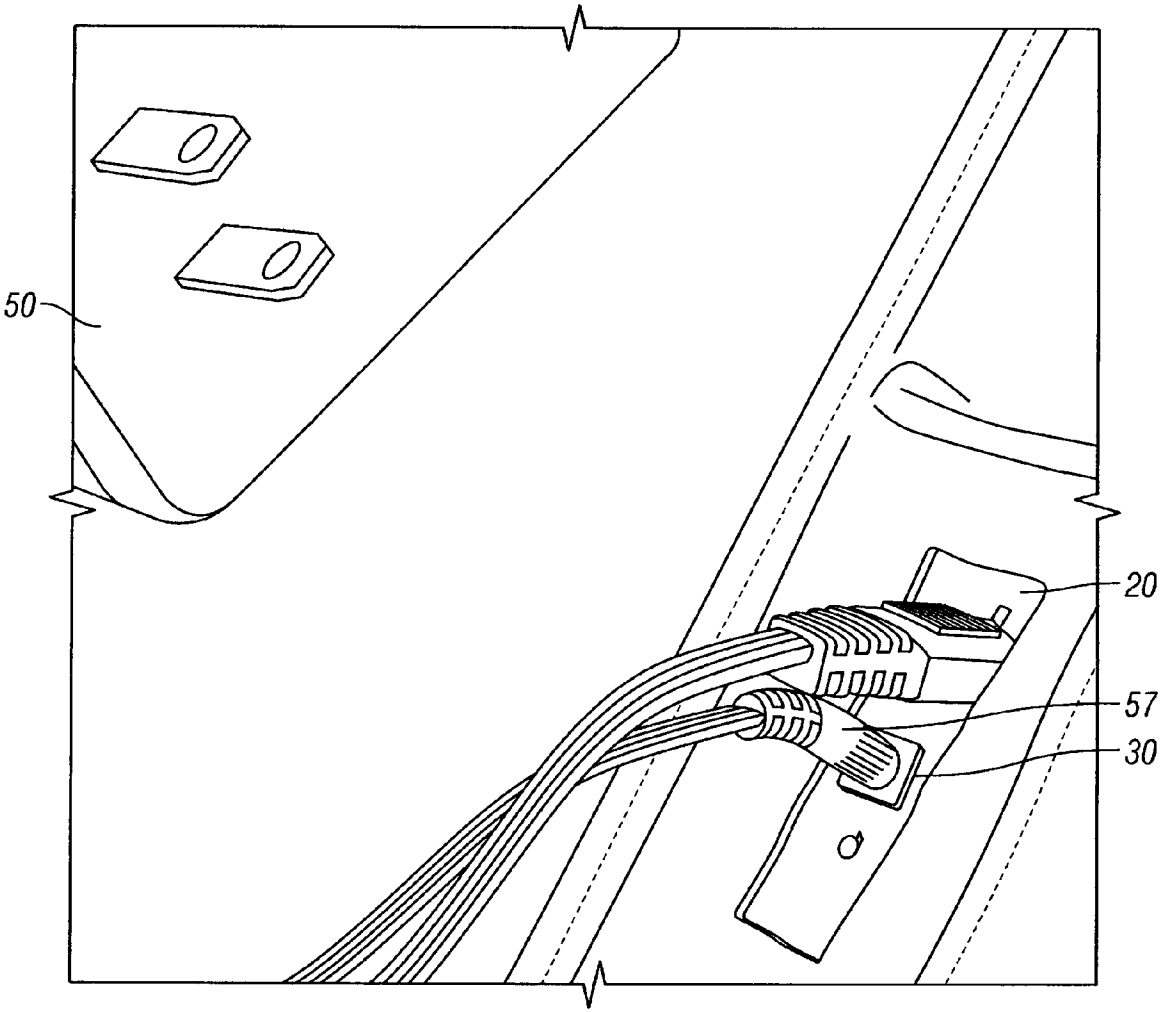
FIG. 5 is a perspective view showing a power panel incorporating an external power source according to the invention.

FIG. 5 shows the power panel 20 having an external power source 50 which terminates in a plug 51 connected to the external power receptacle 30. It can be seen that the external power source in this case is an AC-to-DC converter. Thus, the invention in this embodiment is operative from an AC source while it is charged if desired; or the power tool can simply be charged by the external power source. In other embodiments of the invention, the external power source may be a DC power supply, such as a storage battery. Further, the AC-to-DC converter may be incorporated into the holster/battery pack.

Figure 6:
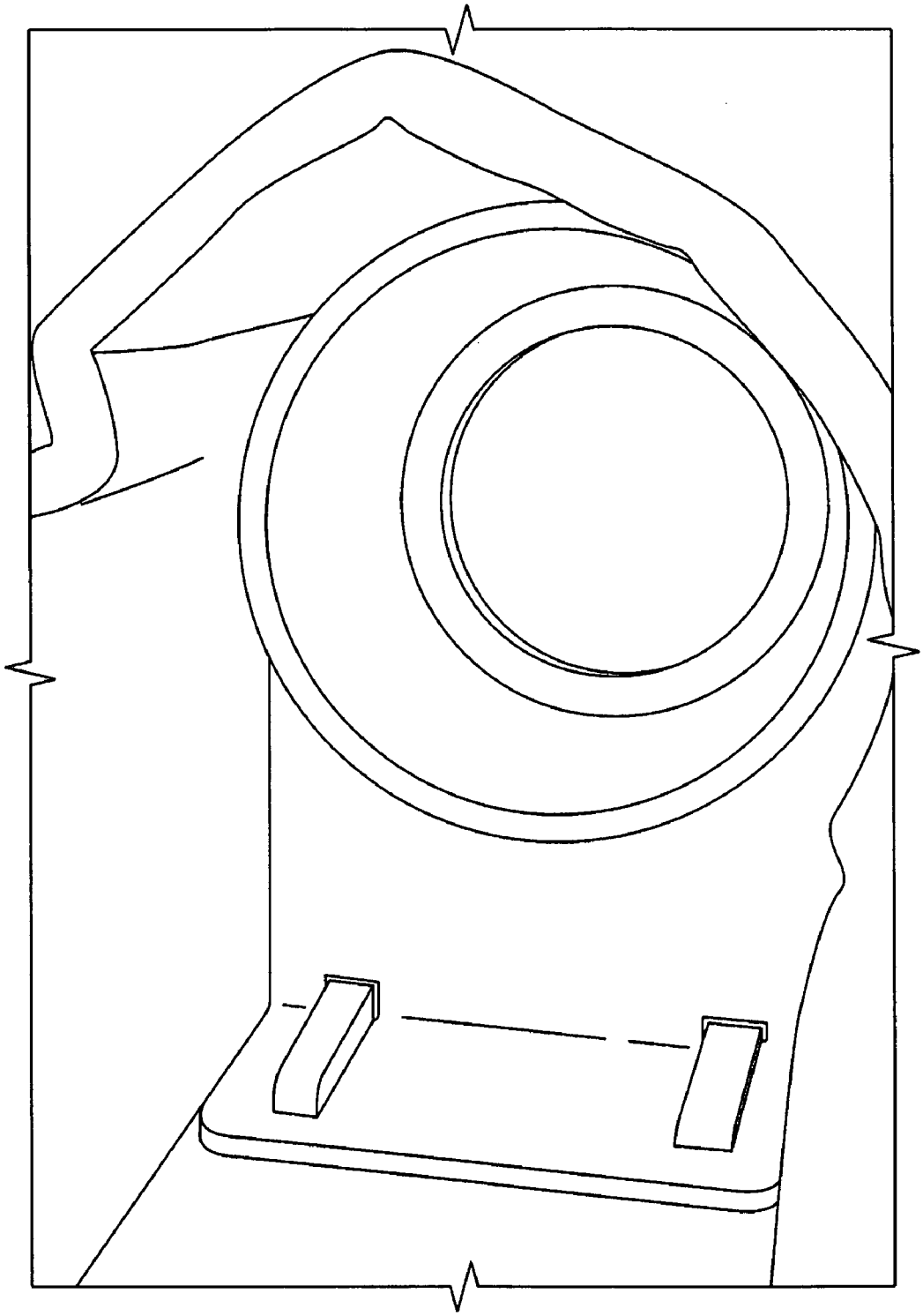
FIG. 6 is a perspective view of a holster bracket according to the invention.

FIG. 6 is a perspective view of an appliance that is placed within the holster portion of the battery pack and which is adapted to accommodate and rigidly hold the power tool within the power pack. The appliance in the this embodiment comprises a rigid holster because that is configured to torque and secure that power tool in the holster. This is particularly important when the holster is made of a soft material, such as canvas, because the holster brackets imparts shape to the holster and maintains such shape. The holster, however, can also be made of rigid materials, such that the holster insert would not be necessary.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. An apparatus comprising:

an electrically operated drill housed in an elongated, substantially cylindrical body shaped both to fit a user's hand and to serve as a handle, where a longitudinal axis of the body is substantially aligned with a rotational axis of the drill;

a power pack physically separate from the body and comprising:

at least one battery supplying direct current electricity to the drill via a flexible power cord;

upon the battery, a first receptacle to detachably receive insertion of an electrical connector coupling the battery to a remote power source to charge the battery;

upon the battery, a second receptacle to detachably receive insertion of an electrical connector coupling the battery to the flexible power cord;

where the first and second receptacles are separate from each other to permit simultaneous connection of the battery to the remote power source and the flexible power cord;

upon the battery, a third receptacle, separate from the first and second connectors, to detachably receive insertion of an electrical connector coupling the battery to a second flexible power cord to supply direct current electricity to an additional electrically operated tool concurrently regardless of whether the battery is concurrently supplying direct current electricity to said drill;

a holster made of a substantially soft material, the holster shaped to house the power pack and the drill and further including:

a flexible appliance to house the drill separately from the battery, the appliance containing a rigid insert shaped to receive and support the drill;

a closure to removably secure the drill within the holster and the insert;

a belt loop to support the holster from a belt passed through the belt loop.

2. The apparatus of claim 1, further comprising a trigger protruding from the elongated, substantially cylindrical body, where the drill is electrically activated responsive to a user depressing the trigger.

3. An apparatus comprising:

an electrically operated drill having a rotational axis;

a housing containing the drill, consisting essentially of an elongated, substantially cylindrical body shaped both to fit a user's hand and to serve as a handle, where a longitudinal axis of the body is substantially aligned with the rotational axis of the drill;

a power pack physically separate from the body and comprising:

at least one battery supplying direct current electricity to the drill via a flexible power cord;

upon the battery, a first receptacle to detachably receive insertion of an electrical connector coupling the battery to a remote power source to charge the battery;

upon the battery, a second receptacle to detachably receive insertion of an electrical connector coupling the battery to the flexible power cord;

where the first and second receptacles are separate from each other to permit simultaneous connection of the battery to the remote power source and the flexible power cord;

upon the battery, a third receptacle, separate from the first and second connectors, to detachably receive insertion of an electrical connector coupling the battery to a second flexible power cord to supply direct current electricity to an additional electrically operated tool concurrently regardless of whether the battery is concurrently supplying direct current electricity to said drill;

a holster made of a substantially soft material, the holster shaped to house the power pack and the drill and further including:

a flexible appliance to house the drill separately from the battery, the appliance containing a rigid insert shaped to receive and support the drill;

a closure to removably secure the drill within the holster and the insert;

a belt loop to support the holster from a belt passed through the belt loop.

4. An apparatus comprising:

an electrically operated drill housed in an elongated, substantially cylindrical body shaped both to fit a user's hand and to serve as a handle, where a longitudinal axis of the body is substantially aligned with a rotational axis of the drill, where the drill is electrically activated by depressing a trigger protruding from the cylindrical body, and where the cylindrical body includes opposite ends including a utility end providing a chuck and a charging end including one of the following: a receptacle to receive a flexible power supply cord, or permanent mounting to one end of the flexible power supply cord;

a power pack physically separate from the cylindrical body and comprising:

at least one battery to supply direct current electricity to the drill via the flexible power supply cord;

upon the battery, a first receptacle to detachably receive insertion of a connector electrically connecting the first receptacle to the flexible power supply cord;

upon the battery, a second receptacle to detachably receive insertion of a connector electrically connecting the second receptacle to a remote alternating current power source to charge the battery;

where the first and second receptacles are separate from each other to permit simultaneous connection of the battery to the remote alternating current power source and the flexible power supply cord;

upon the battery, a third receptacle, separate from the first and second connectors, to detachably receive insertion of a connector electrically coupling the battery to a second flexible power supply cord to supply direct current electricity to an additional electrically operated tool whether or not the battery is supplying direct current electricity to said drill;

a holster made of a substantially soft material, the holster having a forward end and a rearward end opposite to the forward end, the holster shaped to house the power pack and the drill and including:

a belt loop to support the holster by a belt passed through the belt loop;

a flexible appliance to house the drill in a separate compartment from the battery, the appliance containing a substantially circular rigid insert shaped to receive and encircle the drill at the utility end, where the appliance is configured to support the drill in a position such that (1) the charging end is oriented toward the rearward end of the holster and upward at an angle of approximately forty-five degrees from horizontal, and (2) a sufficient amount of the charging end for grasping protrudes from the holster;

a closure to removably secure the drill within the holster and the insert.

* * * * *